US005562549A

United States Patent [19]

Schulze et al.

[11] Patent Number: 5,562,549

[45] Date of Patent: Oct. 8, 1996

[54] AUTOMATIC BOWLING ALLEY

[75] Inventors: Ullrich Schulze, Wiesbaden; Wilhelm Menke, Bingen; Horst Niederlein, Bingen; Boerge Heidersberger, Bingen; Joachim Herrmann, Darmstadt; Bernd Muendel, Bad Kreuznach; Hans-Joachim Pickardt, Bingen, all of Germany

[73] Assignee: NSM Aktiengesellschaft, Bingen, Germany

[21] Appl. No.: 256,653

[22] PCT Filed: Jan. 13, 1993

[86] PCT No.: PCT/DE93/00025

§ 371 Date: Nov. 16, 1994

§ 102(e) Date: Nov. 16, 1994

[87] PCT Pub. No.: WO93/13838

PCT Pub. Date: Jul. 22, 1993

[30] Foreign Application Priority Data

Jan. 21, 1992 [DE] Germany ..... 42 01 530.8

[51] Int. Cl.[6] ..... A63D 3/00

[52] U.S. Cl. ..... 473/73; 473/85; 473/90; 473/116

[58] Field of Search ..... 473/64, 69, 73, 473/85, 86, 87, 89, 90, 91, 93, 94, 95, 97, 100, 103, 116

[56] References Cited

U.S. PATENT DOCUMENTS

| | | | |
|---|---|---|---|
| 1,181,649 | 5/1916 | Downey | 473/85 |
| 2,138,423 | 11/1938 | Kaiserman . | |
| 2,641,471 | 6/1953 | Timberlake | 473/90 |
| 2,791,426 | 5/1957 | Janes | 473/85 |
| 2,848,235 | 8/1958 | Johns et al. . | |
| 4,045,024 | 8/1977 | Breslow et al. . | |
| 5,193,804 | 3/1993 | Smit | 473/73 |

FOREIGN PATENT DOCUMENTS

| | | |
|---|---|---|
| 658093 | 3/1938 | Germany . |
| 2036849 | 1/1972 | Germany . |
| 2259336 | 10/1973 | Germany . |
| 306671 | 7/1955 | Switzerland . |
| 519929 | 4/1940 | United Kingdom . |
| 921619 | 3/1963 | United Kingdom . |

*Primary Examiner*—William M. Pierce
*Attorney, Agent, or Firm*—Spencer & Frank

[57] ABSTRACT

An automatic bowling alley has a bowling lane with two ends. The bowling alley further includes a pin setup frame provided at one end of the bowling lane for handling a plurality of bowling pins. The pin setup frame includes a pin magazine for retaining a number of the pins therebelow. A pin support plate is located below the pin magazine. A device is provided for vertically moving the pin support plate in and out of an initial position and toward and away from the pin magazine to receive the pins from the pin magazine. A device is provided for tilting the pin support plate during the vertical movement into an intermediate tilting position to clear any pins therefrom. A sorting device is located beneath the pin support plate for separating and arranging the pins received therein into an aligned position. A pin conveyor is provided for transporting, in a predetermined position, the pins from the sorting device to the pin magazine.

23 Claims, 8 Drawing Sheets

AUTOMATIC BOWLING ALLEY

BACKGROUND OF THE INVENTION

The invention relates to an automatic bowling alley, particularly a table bowling alley having a pin support plate provided at one end of a bowling lane that receives the pins and with which a pin setup frame is associated that has a pin magazine disposed above the pin support plate, and having a control console provided at the other end of the bowling lane.

In a bowling alley, when the pins are not secured on a cable, with which they can be righted again and positioned on the provided space following a throw, special devices are required with which the fallen pins collected in a pin pit are raised afterwards, supplied to a pin distributor and then placed, at the correct location, onto the bowling alley. The mode of operation of such a pin setup frame is relatively complicated in that it is provided in many bowling game regulations that a second throw is to be taken at the pins still standing after the first throw. Thus, the full set of pins is not to be positioned on the bowling alley each time, which leads to considerable problems in the distribution of the loosely piled-up, fallen pins.

To remedy these problems, a pin setup device for positioning cable-free pins on a pin placement surface is already known from DE-OS 2,259,336; this device comprises a pin magazine disposed above the pin placement surface and having throughgoing openings for pins, and a pin placement surface below this, which can be raised and lowered and has fallen pin pipes that are oriented toward the throughgoing pin openings, with the inside diameter of the fallen pin pipes being only slightly larger than the maximum outer diameter of the pin. The pin placement plate has on its top side gripper forks which can be extended into and retracted from the fallen pin pipes by their fork arms at a right angle to the falling direction of the pins, the gripper fork spacing being less than the pin head diameter. For the case that, following a throw, fallen pins should be cleared away and standing pins should maintain their position, first the standing pins must be lifted, the fallen pins must be cleared away, and subsequently the lifted pins are returned to their old position on the pin placement surface. This requires, along with the additional pin placement plate having the gripper forks associated with the fallen pin pipes, an additional clearing mechanism for the fallen pins.

SUMMARY OF THE INVENTION

The object of the invention is to create a bowling alley of the type mentioned at the outset which permits setup, clearing and repositioning of the pins in a particularly simple and fast manner and, moreover, is distinguished by an uncomplicated and reliably operating design.

Through this measure the fallen, as well as the standing, pins following a throw can first be cleared from the pin support plate by means of transferring the pin support plate into a position that is inclined in reference to the horizontal, with the pin support plate subsequently returning to its horizontal position under the pin magazine, in which position it is provided with pins in the desired pin formation, whereupon the pin support plate returns to its initial position, and the next throw can be made. Consequently, neither a pin placement plate having pin gripper devices nor a pin clearing device is necessary, which results in a structurally simpler and more reliably operating design of the bowling alley.

An alternative solution of the object is distinguished by

- a movable arrangement of the pin support plate into one or a plurality of changeable positions in reference to the pin magazine and the bowling lane,
- a sorting device disposed beneath the pin support plate for separating the pins in an aligned position,
- a pin conveyor for transporting the pins in the correct position from the sorting device to the pin magazine, and
- a release device disposed above the pin magazine for transferring the pins from the pin conveyor into free receiving pockets of the pin magazine.

Through these measures, the setup, clearing and repositioning of pins into predetermined positions are permitted in a particularly simple and fast manner, and long, undesired pauses between the individual throws need not be taken into consideration. Of course, the placement of different pin formations is also possible. Furthermore, the result is a particularly simple and reliably operating design overall of the bowling alley.

In an advantageous embodiment of the invention, after a throw the pin support plate can travel into a horizontal position directly beneath the pin magazine, assuming a short-time intermediate diagonal position to clear away the still-standing and fallen pins, in which horizontal position pins that can be removed from the pin magazine can be placed on the pin support plate in a specific pin formation, and subsequently the equipped pin support plate returns to its initial position. This assures a reliably operating, relatively simple travel of the pin support plate.

In an advantageous modification of the invention, each pin is provided with a metal ball that protrudes from the center of the foot of the pin and is held by a metal plate, and extends into an associated recess configured in the pin support plate when the pins are standing upright, under which recess an electromagnet is located which is connected to a microprocessing computer serving as a central control unit, in which modification a securing of the pins on the pin support plate, a grasping of the pins stored in the pin magazine, an inquiry regarding the pins that lie fallen following a throw, and determination of the receiving pockets that are occupied by a pin can be executed by way of the electromagnets. By means of this, the position and status of the individual pins are determined in a simple manner and, at the same time, a possibly necessary securing of the pins on the pin support plate and removal of the pins from the pin magazine are effected. The metal plate of the pins assures the necessary magnetic circuit with the electromagnets.

In order to achieve reliable transport of the pins, in accordance with an advantageous modification of the subject of the invention, the pin conveyor comprises a circulating chain having carriers rotatably hinged to it with specific spacing for grasping the individual pins from the sorting device, and with which the pins can be moved above and past receiving pockets of the driven, circular pin magazine, which pockets are disposed in one plane, and the releasing device comprises deflection elements along the transport path above the pin magazine in order to eject the pins into the receiving pockets during a short-time change in the running direction of the chain, during which the deflection elements can assume an active or an inactive position, depending on whether the associated receiving pocket is free or occupied by a pin.

For secure seating of the pins in the receiving pockets, in a further advantageous embodiment of the invention, the pins are held in a self-clamping manner in the tubular receiving pockets of the pin magazine, with the foot of the pin protruding slightly from the underside of the receiving pocket.

For the purpose of achieving a reliably operating drive of the pin magazine, in an advantageous modification of the invention, the circular pin magazine can be driven by means of a synchronous belt drive whose driving motor hung to swing freely.

In order to achieve separation of the fallen pins in their diagonal position from the pin support plate in a simple manner, in according to a further embodiment of the invention, the sorting device includes a driven rotary table for receiving cleared pins, from which pins can be transported one above the other and in an upright position into a collecting shaft by way of a pin deflector, from which shaft the pins can be removed from below, one after another, from the carriers of the circulating chain of the chain conveyor. In this instance, the rotary table surrounded by a stationary side wall is advisably disposed with an incline to the horizontal, and, in the region of greatest inclination of the rotary table, a throughgoing pin hole is provided in the side wall with the associated, angular pin deflector, which ejects pins in the righted position into the collecting shaft during a brief change in the direction of rotation of the rotary table, and guides pins in the non-upright position past the throughgoing pin opening.

So that the pins guided past the pin deflector in a non-upright position can be reliably transferred into an upright position, in accordance with an advantageous modification of the subject of the invention, a pin turner is disposed downstream of the pin deflector in the direction of rotation of the rotary table, which pin turner transfers the pins lying at the edge of the rotary table in a non-upright position into an upright position. The pin turner preferably has an easily braked turnstile whose gripping arms, which are bent counter to the direction of rotation of the rotary table, project through a window in the stationary side wall of the rotary table into the region of the edge of the rotary table.

To avoid a confused tangle and a jamming of the pins on the rotary table, in a modification of the invention, a pin jam breakup device in front of the pin deflector in the direction of rotation is associated with the rotary table, which device only allows pins to pass on the edge of the rotary table in a separated position. The pin jam breakup device advisably comprises a four-wing rotor driven counter to the direction of rotation of the rotary table, and whose wings extend up to the edge of the rotary table that receives pins one behind another. To permit easy lifting of the pins, the wings of the four-wing rotor, which are preferably made of a rubber-elastic material, are chamfered at their free ends in the direction of the rotary table. So that the pins do not enter the pin jam breakup device from above, a diagonal cover is advisably disposed above the pin jam breakup device.

To reduce the haphazard spinning of pins on the rotary table, in an advantageous embodiment of the invention, a semicircular, stationary cover plate which leaves the edge of the rotary table free and is supported on rollers recessed into the rotary table is provided beneath the pin jam breakup device. The cover plate is advisably provided in the vicinity of the edge of the rotary table with at least one nub-like bump, by means of which the separation of the pins is supported.

For simple realization of the traveling movement of the pin support plate, it is preferably provided that the upward and downward movement of the pin support plate is effected by means of two opposite chain drives driven by a common motor and cooperating respectively with a sliding control element to execute the intermediate diagonal position of the pin support plate during the upward movement of the same. Each sliding control element advisably comprises a sliding member secured to the associated side wall of a support frame, into which sliding element a lug of a support extends which is connected to a support shaft extending through a guide slot in the side wall, and a lug secured to the endless chain of the chain drive extends so as to glide into a longitudinal hole of the support.

To execute different bowling games, according to an advantageous embodiment of the invention, the pin support plate can be provided with different geometrical arrangements of the pins.

So that rapid filling of the pin magazine can always be effected, in accordance with an advantageous embodiment of the invention, a plurality of sets of the pins required for the geometric arrangement of the pins on the pin support plate are in circulation.

For the purpose of achieving noise damping, the pins are advisably made of a non-metallic material.

BRIEF DESCRIPTION OF THE DRAWINGS

The concept underlying the invention is described in detail in the following description by way of an embodiment illustrated in the drawings. Shown are in.

DETAILED DESCRIPTION OF THE INVENTION

Figure 1:
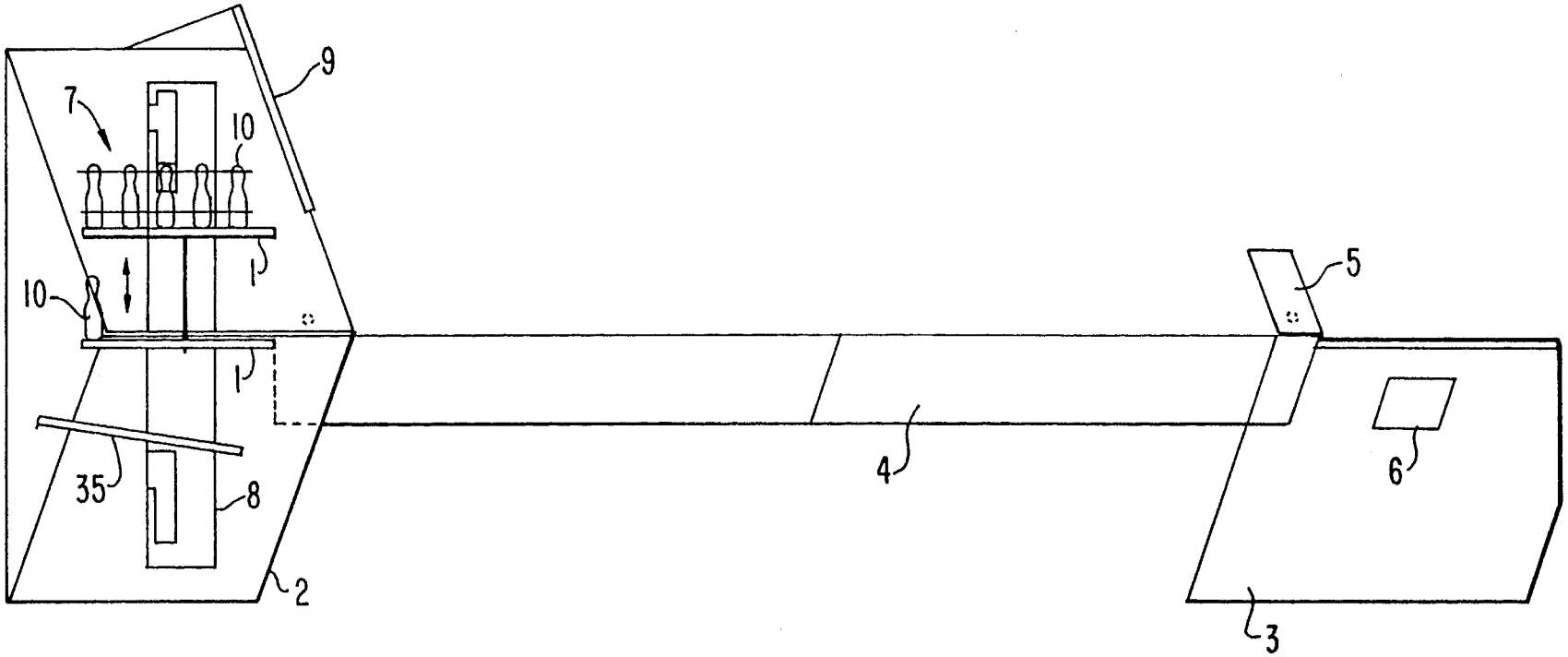
FIG. 1 a side view of a table bowling alley according to the invention having an indicated pin setup frame, FIG. 2 an enlarged side view of the pin setup frame according to FIG. 1 having three different positions of the pin support plate, FIG. 3 a front view of the pin setup frame according to FIG. 2 having the pin support plate located in the initial position, FIG. 4 an enlarged representation of the pin support plate having an associated drive, FIG. 5 a side view of the drive of the pin support plate according to FIG. 4 in the direction of arrow V, but without the cover plate, FIG. 6 the representation according to FIG. 5 with the pin support plate having assumed the diagonal position, FIG. 7 a top view of the rotary table disposed beneath the pin support plate according to FIG. 3, and FIG. 8 a top view of the pin magazine disposed above the pin support plate according to FIG. 3.
Figure 2:
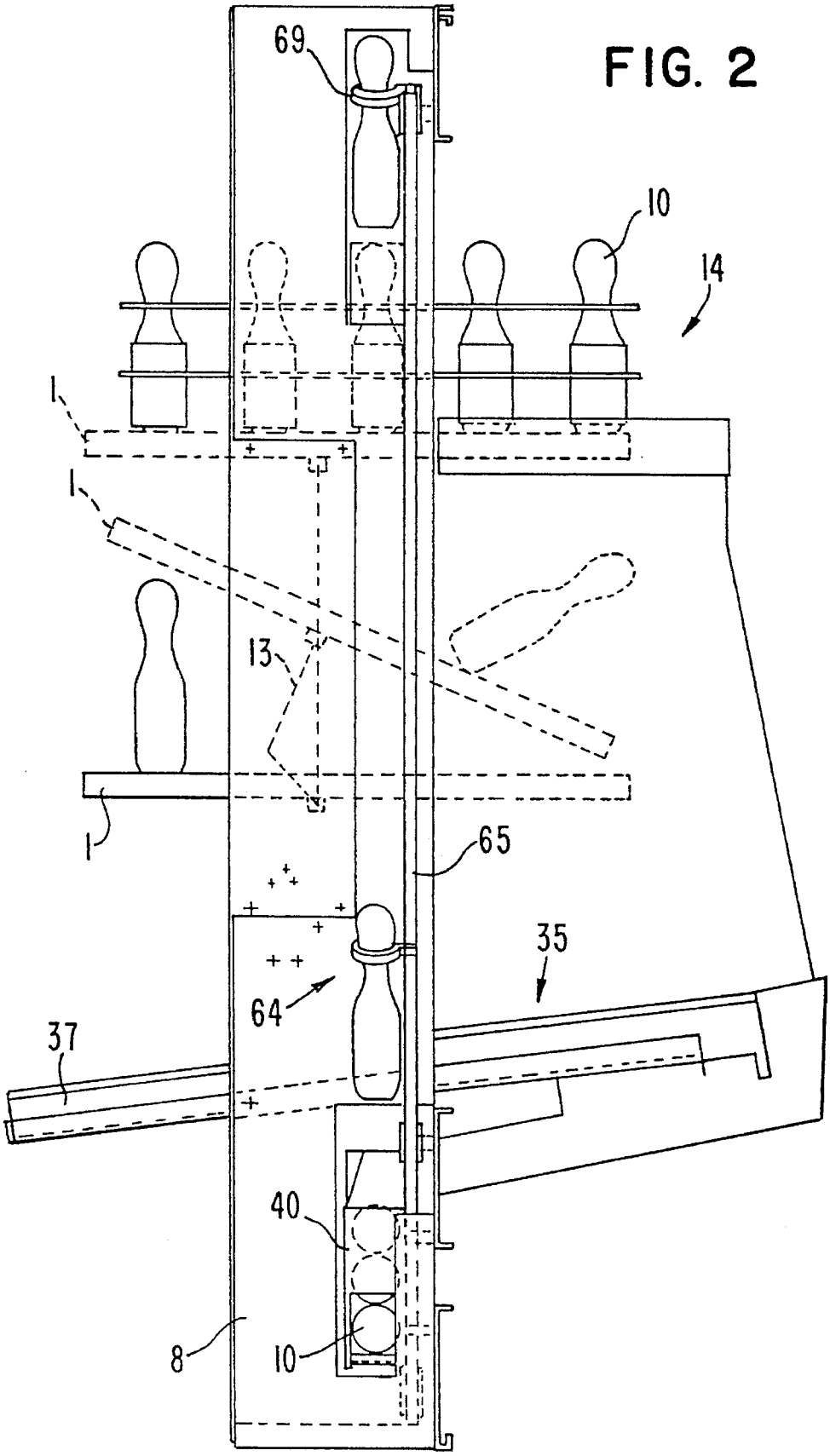
Figure 3:
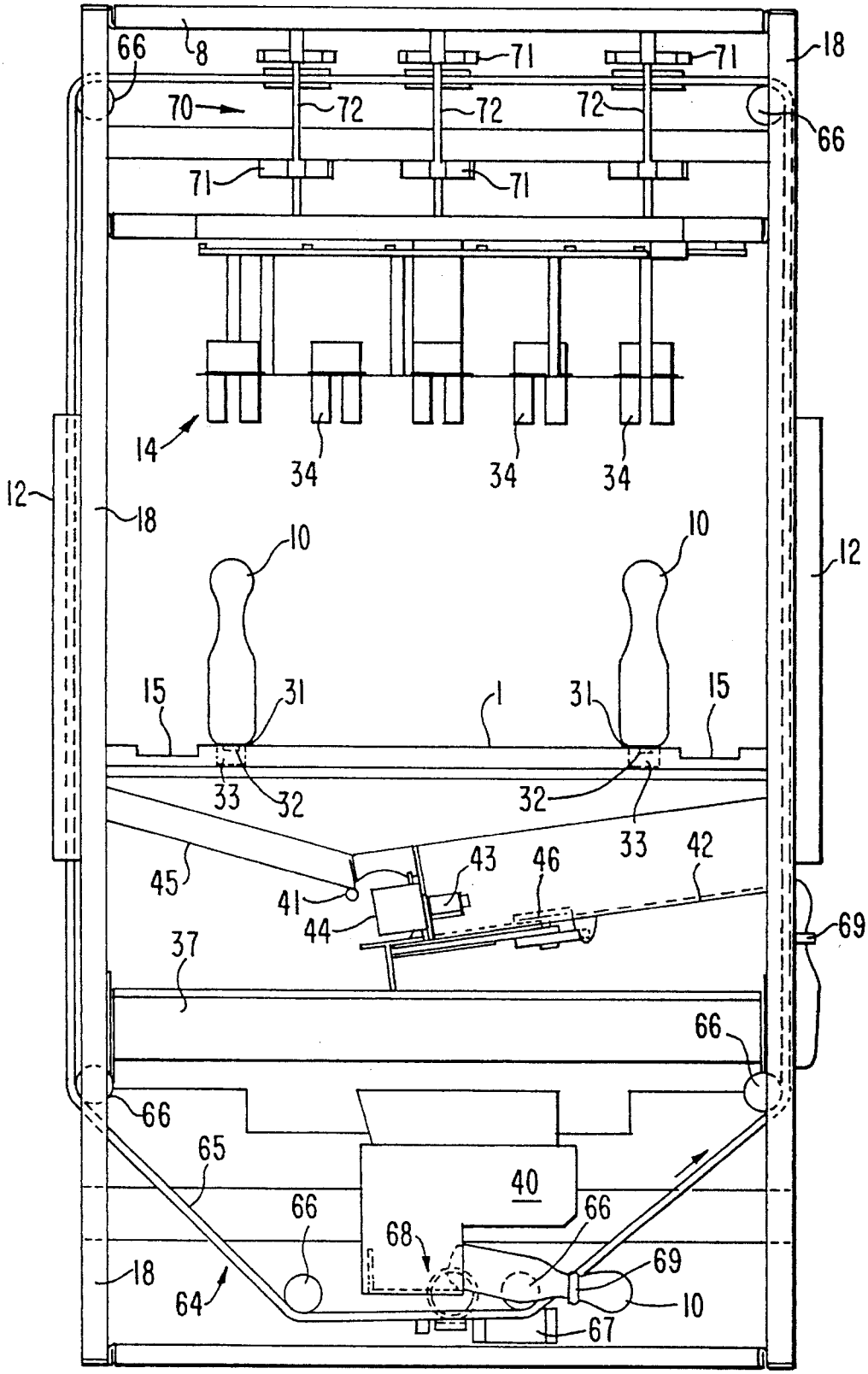
Figure 4:
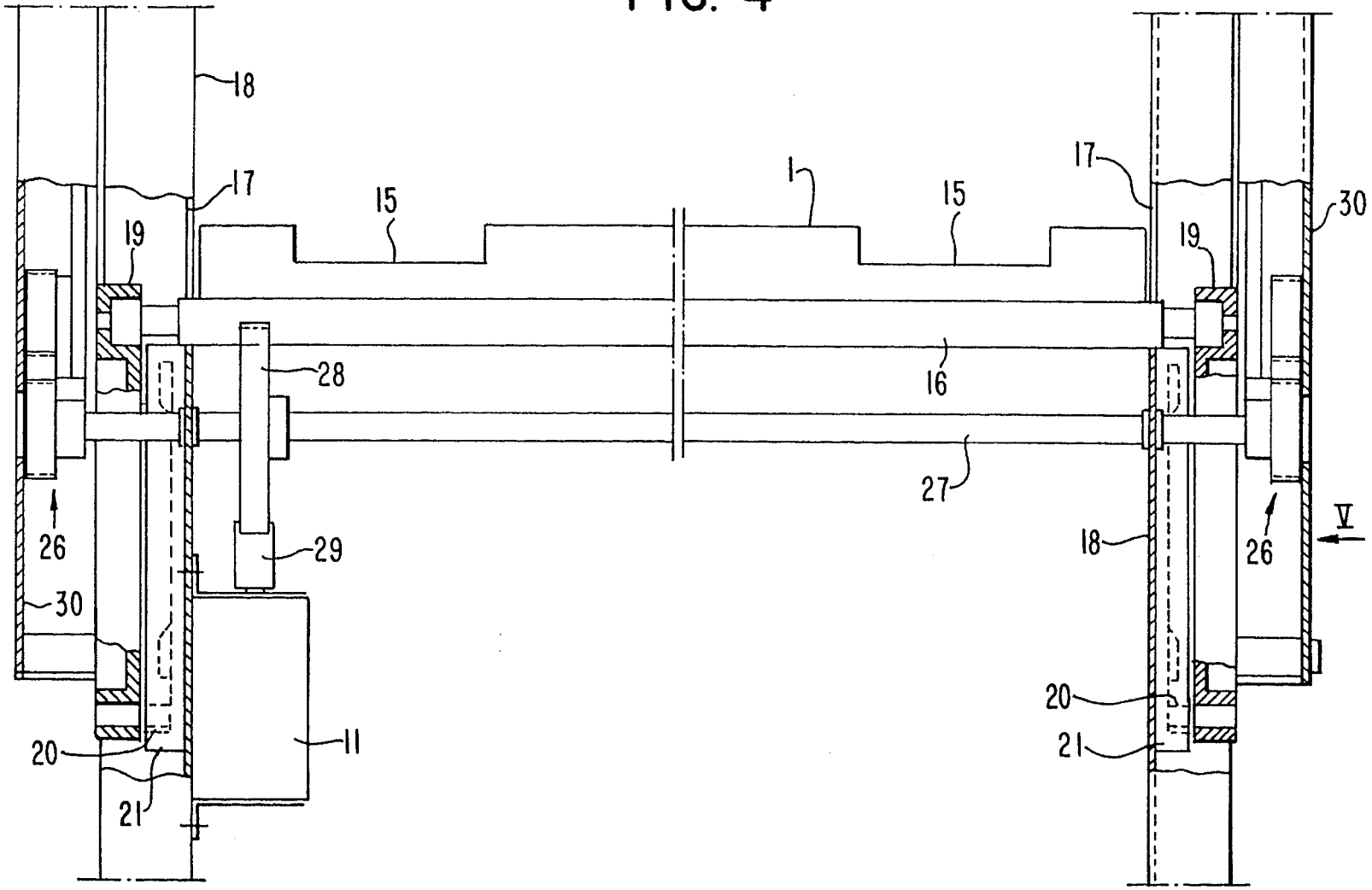
Figure 5:
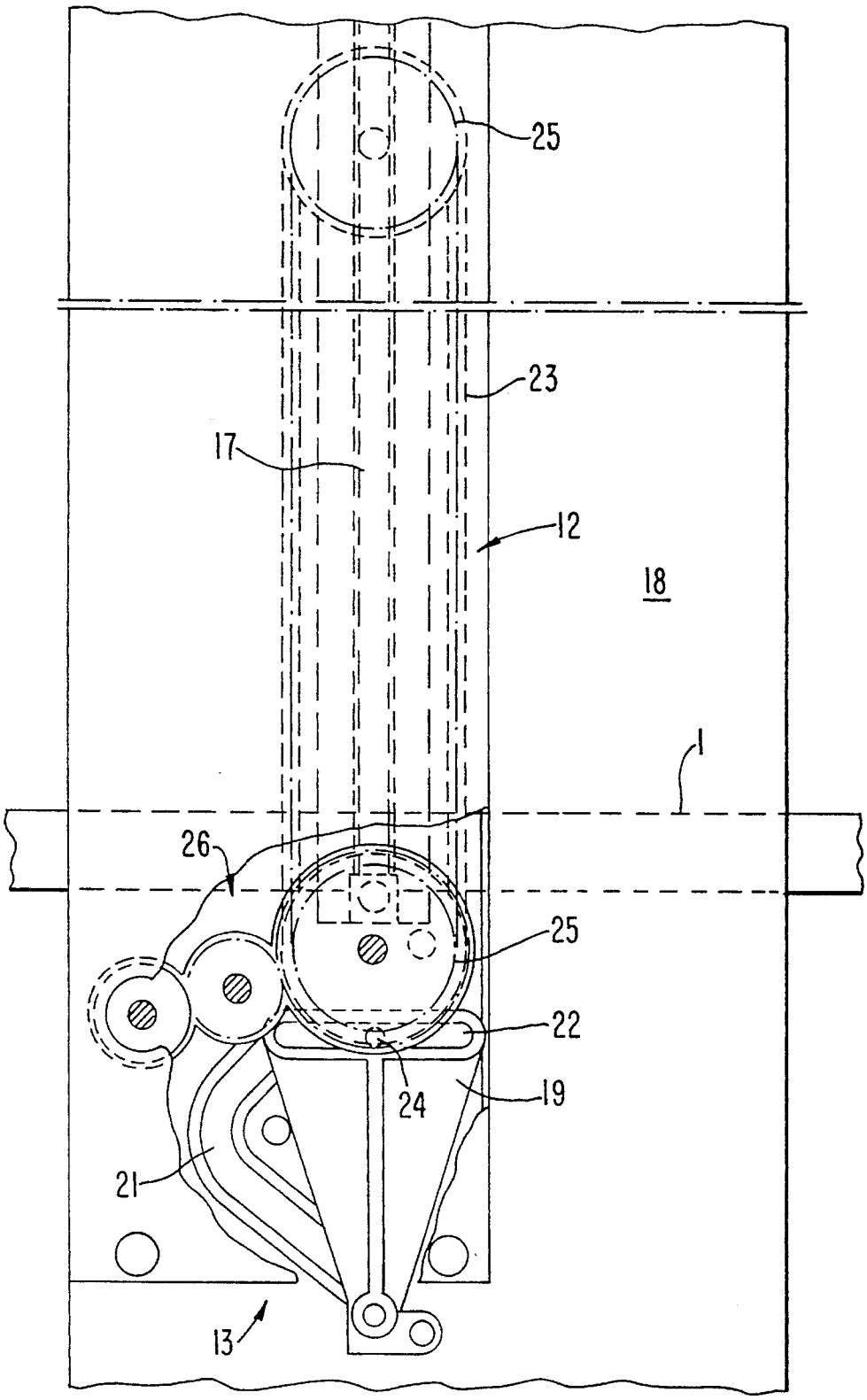
Figure 6:
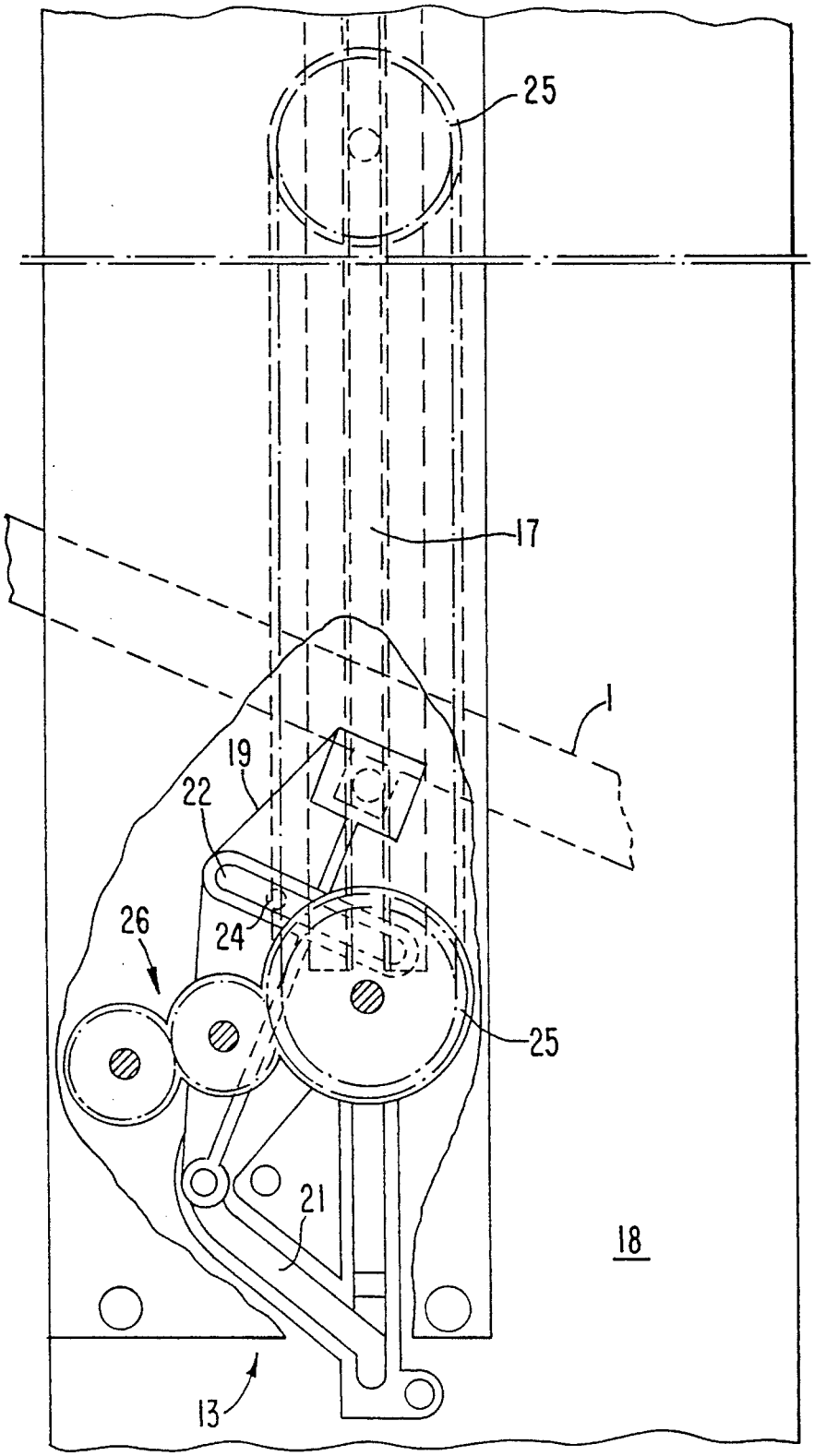
Figure 7:
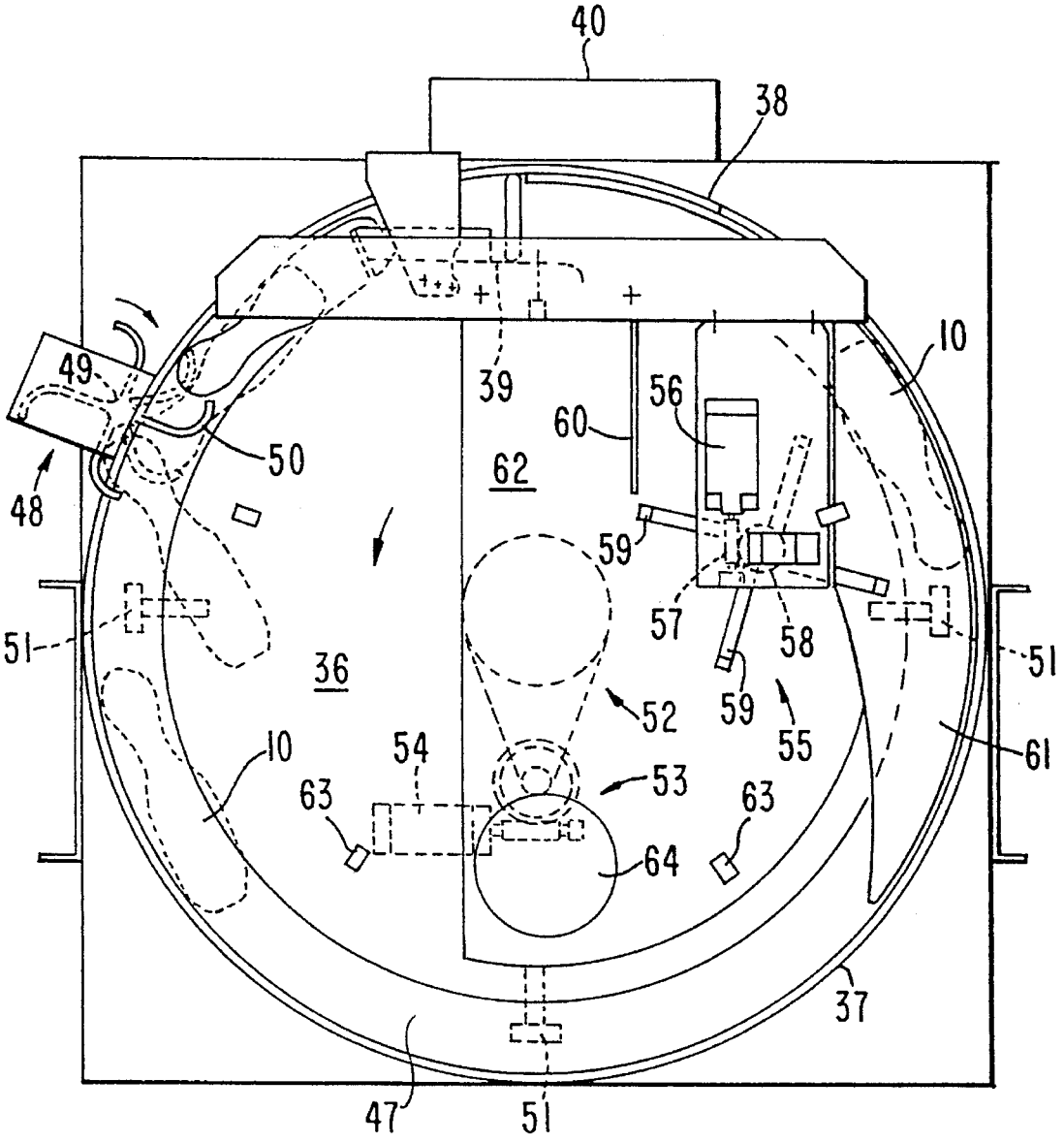
Figure 8:
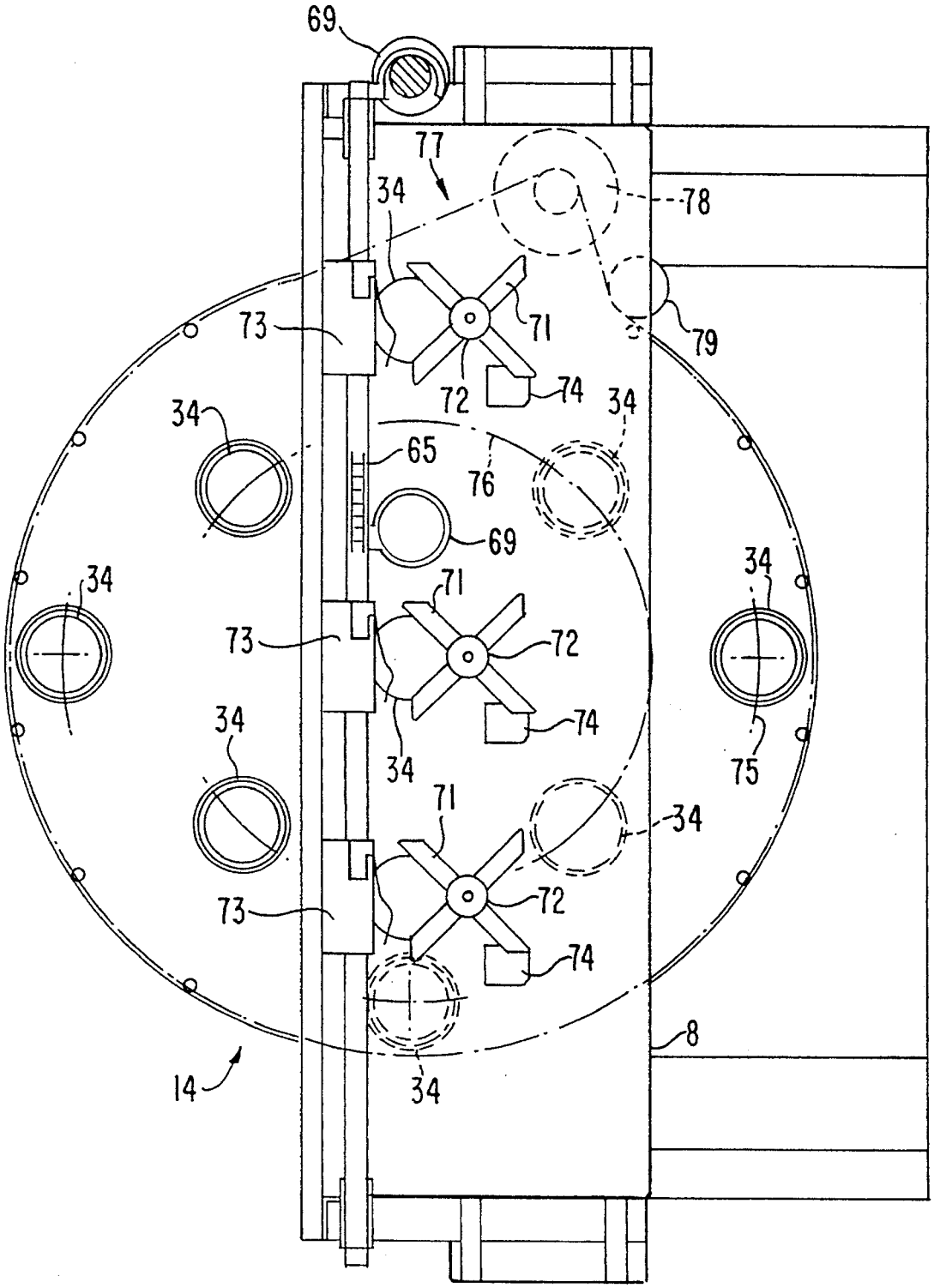

The table bowling alley has a rear stand housing 2 which encompasses the traveling pin support plate 1 in the manner of a hood, a front base housing 3 that supports the ball positioning region of a bowling lane, and a connecting housing 4 lying between them that receives the bowling lane and a ball return groove located underneath. In its front region, the connecting housing has a bridge 5 that extends over the bowling lane and has a recessed key panel for controlling the individual functions of the table bowling alley. A coin-processing system for assuring a credit for the startup of the table bowling alley, and a ball-catching pocket 6 connected to the ball return groove for removing the ball are located inside the base housing 3. Inside the stand housing 2, the pin support plate 1 is allocated a pin position system 7, both of which are secured to a common support frame 8. Furthermore, a display panel 9 is recessed in the front side of the stand housing 2 for representing the position and the status of the individual pins 10, the selected game type, the respective playing status, the credit and the like.

The pin support plate 1 can be moved upwardly and downwardly out of its initial position, in which it is flush with the bowling lane, by way of two opposite chain drives 12 driven by a common motor 11. The chain drives 12 are respectively in active connection with a sliding control element 13 in such a way that, during an upward movement of the pin support plate, this plate assumes an intermediate diagonal position to clear away the pins 10, and then travels until it is closely beneath a pin magazine 14 disposed above the pin support plate 1, returning to its horizontal position. In this position, the pin support plate is provided with the desired pin formation, and then subsequently returns to its initial position. The pin support plate 1 provided with ball gutters 15 is supported on a support shaft 16 that extends at the end side through a guide slot 17 in the opposite side walls 18 of the support frame 8. The ends of the support shaft 16 are respectively connected to a support 19 that extends with a lug 20 into a sliding member 21 secured to the side wall 18. The support 19 has a longitudinal hole 22 extending parallel to the initial position of the pin support plate 1, into which hole a lug 24 secured to the endless chain 23 of the chain drive 12 extends. The chain wheels 25 of the chain drive 12, which lie in the plane of the guide slot 17, are connected by way of a toothed wheel gear 26 associated with the lower chain wheel 25 to a drive shaft 27 extending parallel to the initial position of the pin support plate 1. The drive shaft 27 is coupled by way of a worm wheel 28 and a screw 29 with the motor 11, which is controlled by means of a microprocessing computer serving as a central control unit. Additionally, the chain drives 12 are protected, with the respective associated sliding control element, by a cover 30.

Recesses 31, which are respectively allocated an electromagnet 32, are located in the pin support plate 1. The pins 10 standing upright extend into these recesses with a metal ball 33 protruding from the center of the foot of the pin and held by a metal plate 80.

Corresponding to their switching status, the electromagnets 32 connected to the microprocessing computer permit, on the one hand, the pins 10 to be pulled out from the pin magazine 14, and the pins 10 to be secured on the pin support plate 1 and, on the other hand, an inquiry of the pins 10 that lie fallen after a throw, as well as determination of the receiving pockets of the pin magazine 14 occupied by a pin, and the corresponding data are stored in the microprocessing computer.

A sorting device 35 for separating the pins 10 cleared away from the pin support plate 1 in an aligned position is located beneath the pin support plate 1. The sorting device 35 has a rotary table 36 disposed at an incline with respect to the horizontal, and is surrounded by a stationary side wall 37. In the region of the steepest inclination of the rotary table 36, a throughgoing pin opening 38 is cut into the side wall 17, with which opening an angular pin deflector is associated in such a way that, with a simultaneous, short-time change in the direction of rotation of the driven rotary table 36, pins 10 are ejected in an upright foot/head position into a collecting shaft 40 disposed downstream of the throughgoing pin opening 38, in which shaft they are stacked one above the other, while pins 10 in the non-upright head/foot position are guided past the throughgoing pin opening 38 by the pin deflector 39. A transversely-extending screen 41 that deflects balls to the ball return groove is provided above the rotary table 36 and is at a distance from a diagonal partial cover 42 of the rotary table 36 that is smaller than the ball diameter, but larger than the maximum pin diameter. A ball block 44 that can be actuated by an electromagnet 43 is located in the transition region from the screen 41 to the ball return groove. On the side opposite the partial cover 42, the screen 41 is connected by way of a diagonal cover 45 to the corresponding side wall 18 of the support frame 8. The pins and balls falling onto the diagonal cover 45 are conducted further from this cover to the partial cover 42. To convey the pins lying on the partial cover 42 reliably into the rotary table 36, the partial cover 42 is provided with a motor-driven wiper blade 46.

The edge 47 of the rotary table 36 that receives the pins 10 in a position one behind the other is provided with a brake liner. A pin turner 48, which transfers the pins 10 arriving in a non-upright position into an upright position, is associated with this edge 47 of the rotary table 36 behind the pin deflector 39 in the direction of rotation of the rotary table 36. The pin turner 48 comprises an easily braked turnstile 49, whose gripping arms 50 bent counter to the direction of rotation of the rotary table 36 project through a window in the side wall 37 into the region of the edge 47 of the rotary table 36. The head of a pin arriving in a non-upright position is grasped by a gripping arm 50, and then the pin is pivoted by 180° onto the bulge because of its forced transport and the effect of the following gripper arm 50, so that it comes to rest in an aligned position at the edge 47 of the rotary table 36.

The rotary table 36 seated on support rollers 51 is connected by way of a synchronous gear 52 and a worm gear 53 to a driving motor 54. A pin jam breakup device 55, which has a four-wing rotor 58 that can be driven by way of a driving motor 56 with worm gear 57, is located in front of the pin deflector 39 in the direction of rotation of the rotary table. The wings 59 of the four-wing rotor 58, which are made of a rubber-like material, are chamfered at their free ends in the direction of the rotary table 36, and extend to the edge 47 of the rotary table 36. A pin deflection sheet 60 is associated with the rear region of the four-wing rotor 58. A diagonal cover 61 is disposed above the pin jam breakup device 55. A semicircular, stationary cover plate 62, which leaves the edge 47 of the rotary table 36 open and is also supported on rollers 63 recessed into the rotary table 36, lies beneath the pin jam breakup device 55. The cover plate 62 has a burl-like bump 64 on the side opposite the pin deflector 39. The pin jam breakup device 55 thus ensures that pins are always only supplied to the pin deflector 39 in a separated position, one behind the other.

From the collecting shaft 40, the pins 10 are transported to the pin magazine 14 by means of a pin conveyor 64. The pin conveyor 64 encompasses an endless chain 65, which is guided on rollers 66 secured to the support frame 8, and is driven by a driving motor 67 having an associated worm gear 68. The endless chain 65, which extends beneath the collecting shaft 40 and above the pin magazine 14, has carriers 69 rotatably hinged thereto with specific spacing, which carriers grasp a pin 10 out of this collecting shaft 40, by the pin neck in the correct position, while passing the underside of this collecting shaft 40. The chain 65 circulating counterclockwise transports the pins to a releasing device 70, which is located above the pin magazine 14 and has three deflecting elements 72 comprising two turnstiles 71 located one above the other. A microswitch 73 that determines whether a pin is in the ejection position is associated with each deflecting element 72. Moreover, each rotatable deflection element can be acted upon by a stopping device 74 that prevents a rotational movement of the deflection element 72 during active functioning; a pin is ejected into the associated receiving pocket 34 of the pin magazine 14 during a short-time change in the running direction of the chain 65.

The circular pin magazine 14 has on an outer circular line 76 four receiving pockets 34 disposed equidistantly from one another and, on an inner circular line 76, four receiving pockets 34 disposed aligned with gaps of the outer circular line. A further receiving pocket 34 is located in the center of the pin magazine 14. The three deflecting elements 72 located in a parallel plane to the chain 65 are associated with the outer circular line 75, the inner circular line 76 and the center of the pin magazine 14. The pins 10 are held in a self-clamping manner in the tubular receiving pockets 34 in such a way that the foot of the pin protrudes slightly beyond the underside of the receiving pocket 34, by means of which the pin can be pulled out of the receiving pocket 34 when the corresponding electromagnet 32 of the pin support plate 1 reaches the position beneath the pin magazine 14.

The pin magazine 14, which can be driven by means of a synchronous belt drive 77 having a driving motor 78 hung to swing freely and associated tension roller 79 travels, computer-controlled, into a loading position for a free receiving pocket 34; filling of the receiving pockets 34 lying on the outer circular line 75 and the inner circular line 76 is effected alternatingly. The filling of the central receiving pocket 34 is possible at any time without a prior rotational movement of the pin magazine 14.

The above description of the drawings has clarified in detail the construction and the use of the table bowling alley of the invention. It is understandable to a person skilled in the art that the underlying concept of the present invention can have a significantly broader application, and is not limited to the embodiment specially examined here.

We claim:

1. An automatic bowling alley having a bowling lane with two ends and a plurality of pins, said bowling alley further comprising:

a pin setup frame provided at one end of the bowling lane for handling a plurality of bowling pins, and having:

a pin magazine for releasably retaining a number of the pins therebelow;

a pin support plate located below said pin magazine;

means for vertically moving said pin support plate out of an initial, lower horizontal position and upward toward said pin magazine into an upper horizontal position to receive the pins from said pin magazine, and for vertically moving said pin support plate downward away from said pin magazine and back into the initial position;

means for tilting said pin support plate during the upward vertical movement into an intermediate tilting position to clear any pins therefrom;

sorting means located beneath said pin support plate for separating and arranging the pins received therein into an aligned position; and pin conveyor means for transporting, in a predetermined position, the pins from said sorting means to said pin magazine.

2. The automatic bowling alley defined in claim 1, further comprising a control console provided at the other end of the bowling lane for controlling an operation of said pin setup frame.

3. The automatic bowling alley defined in claim 1, wherein said bowling alley is a table bowling alley.

4. The automatic bowling alley defined in claim 1, wherein said pin magazine includes a plurality of pin receiving pockets; and wherein said pin setup frame further comprises a release device positioned above said pin magazine for transferring the pins from said pin conveyor into free receiving pockets of said pin magazine.

5. The automatic bowling alley defined in claim 28, wherein said pin magazine is circular shaped and driven to move, and the pin receiving pockets are arranged in one plane; and wherein said pin conveyor means comprises a circulating chain extending from said sorting means to said pin magazine, and rotatably hinged carriers attached to said chain with a predetermined spacing therebetween, each said hinged carrier grasping an individual pin from said sorting means and moving the pins along a transport path above and past respective receiving pockets; said release device including a plurality of deflection elements along the transport path and located above said pin magazine, said deflection elements ejecting the pins from said hinged carriers and into the receiving pockets, said deflection elements being activated in dependence on whether the associated receiving pocket is free or occupied by a pin.

6. The automatic bowling alley defined in claim 5, wherein said receiving pockets are tubular shaped, and hold the respective pins in a self-clamping manner; and wherein a foot of the held pins protrudes from an underside of the respective receiving pockets.

7. The automatic bowling alley defined in claim 1, wherein said pin magazine includes a plurality of pin receiving pockets; and said pin support plate includes a plurality of recesses each for receiving a corresponding metal ball protruding from a center of a foot of the pin, and a plurality of electromagnets located beneath the respective recesses; further comprising a microprocessing means connected to said electromagnets for actuating said electromagnets to securely hold the pins on said pin support plate, and to grasp the pins stored in said pin magazine, said microprocessor means further determining which pins lie fallen after a throw, and determining which of the receiving pockets of said pin magazine are occupied by a pin.

8. The automatic bowling alley defined in claim 1, wherein said pin magazine is circular shaped; and wherein said pin setup frame further comprises a synchronous drive having a driving motor hung to swing freely for driving said circular pin magazine.

9. The automatic bowling alley defined in claim 1, wherein said sorting means comprises a driven rotary table for receiving pins cleared from said pin support plate, a collecting shaft receiving the pins from said rotary table, and pin deflector means for transporting the pins in an upright position and one above the other from said rotary table and into said collecting shaft; and wherein said pin conveyor means comprises a circulating chain extending from said sorting means to said pin magazine, and rotatably hinged carriers attached to said chain, said hinged carriers removing the pins one after the other from said collecting shaft.

10. The automatic bowling alley defined in claim 9, wherein said sorting means includes a stationary side wall surrounding said rotary table and having a pin opening therethrough, said rotary table being positioned at an inclination relative to the horizontal, and said stationary side wall being arranged so that the pin opening is located in a region of a steepest inclination of said rotary table; wherein said pin deflector means is angularly arranged and is located on said rotary table adjacent to the pin opening, said pin deflector means throwing upright pins through the pin opening and into said collecting shaft and guiding non-upright pins past the pin opening.

11. The automatic bowling alley defined in claim 9, wherein said sorting means includes a pin turner means arranged downstream of said pin deflector means in a direction of rotation of said rotary table, said pin turner means transferring pins lying at an edge of said rotary table in a non-upright position into an upright position.

12. The automatic bowling alley defined in claim 11, wherein said sorting means includes a stationary side wall surrounding said rotary table and having a window opening therethrough, and wherein said pin turner means comprises a turnstile having a plurality of gripping arms bent counter to the direction of rotation of said rotary table and projecting through the window into a region of the edge of said rotary table.

13. The automatic bowling alley defined in claim 9, wherein said sorting means includes a pin jam breakup means located in front of said pin deflector means relative to a direction of rotation of said rotary table for only allowing pins to pass on an edge of said rotary table separated from each other.

14. The automatic bowling alley defined in claim 13, wherein said pin jam breakup means includes a four-wing rotor driven counter to the direction of rotation of said rotary table, each wing of said four-wing rotor extending to the edge of said rotary table.

15. The automatic bowling alley defined in claim 14, wherein said wings of said four-wing rotor are composed of a rubber material, and are chamfered at a respective free end in a direction of said rotary table.

16. The automatic bowling alley defined in claim 14, wherein said sorting means includes a diagonal cover positioned above said pin jam breakup means.

17. The automatic bowling alley defined in claim 14, wherein said sorting means includes a semicircular, stationary cover plate arranged to leave the edge of said rotary table open, and being located beneath said pin jam breakup means; and wherein said rotary table includes a plurality of rollers recessed therein, said rollers supporting said cover plate.

18. The automatic bowling alley defined in claim 17, wherein said cover plate includes at least one burl bump in a region of the edge of said rotary table.

19. The automatic bowling alley defined in claim 1, wherein said means for vertically moving comprises two oppositely arranged chain drives driven by a common motor and being connected to said pin support plate; and wherein said means for tilting comprises two sliding control elements each being connected to a respective chain drive.

20. The automatic bowling alley defined in claim 19, wherein said pin setup frame further comprises a support frame having two side walls, each extending along a respective chain drive, and each having a respective vertically extending guide slot formed therein; wherein each sliding control element comprises a sliding element secured to the respective side wall, a movable support having a longitudinal hole extending parallel to the position of said pin support plate, and a lug extending into said sliding element; said pin support plate including a support shaft extending through each guide slot and being connected to said movable supports; and said chain drives each comprise an endless chain, and an additional lug secured to the endless chain and extending so as to slide in the longitudinal hole of said movable support.

21. The automatic bowling alley defined in claim 1, wherein said pin setup frame further comprises means for arranging said pin support plate with different geometrical arrangements of the pins.

22. The automatic bowling alley defined in claim 21, wherein said means for arranging includes means for circulating a plurality of sets of the pins required for the geometrical arrangements.

23. The automatic bowling alley defined in claim 1, wherein the pins are composed of a non-metallic material.

* * * * *